US010512128B2

(12) United States Patent
Rodriguez et al.

(10) Patent No.: US 10,512,128 B2
(45) Date of Patent: Dec. 17, 2019

(54) MODULAR LIGHT-EMITTING DIODE FIXTURES

(71) Applicant: ABL IP Holding LLC, Atlanta, GA (US)

(72) Inventors: Yan Rodriguez, Suwanee, GA (US); Thomas Edward Harris, Oxford, GA (US); Antonio Marques, Covington, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/226,935

(22) Filed: Dec. 20, 2018

(65) Prior Publication Data

US 2019/0124734 A1 Apr. 25, 2019

Related U.S. Application Data

(62) Division of application No. 15/216,932, filed on Jul. 22, 2016, now Pat. No. 10,201,044.
(Continued)

(51) Int. Cl.
*H05B 33/08* (2006.01)
*F21S 2/00* (2016.01)
*H05B 37/02* (2006.01)

(52) U.S. Cl.
CPC ..... *H05B 33/0806* (2013.01); *F21S 2/005* (2013.01); *H05B 33/0887* (2013.01);
(Continued)

(58) Field of Classification Search
CPC ..... H05B 33/0887; H05B 33/0806; H05B 33/0827; H05B 33/0842; H05B 37/0227; F21S 2/00; F21S 2/005
See application file for complete search history.

(56) References Cited

U.S. PATENT DOCUMENTS 10,201,044 B2 2/2019 Rodriguez
2006/0197474 A1 9/2006 Olsen
(Continued)

FOREIGN PATENT DOCUMENTS

CA 2937020 C 6/2018

OTHER PUBLICATIONS

CA 2,937,020 received a Notice of Allowance, dated Jan. 19, 2018, 1 page.
(Continued)

*Primary Examiner* — Tung X Le
*Assistant Examiner* — Borna Alaeddini
(74) *Attorney, Agent, or Firm* — Kilpatrick Townsend & Stockton LLP

(57) ABSTRACT

A master lighting fixture and a satellite lighting fixture can each include an LED board including multiple LEDs that can emit visible light. A power supply and a LED regulator can be connected to the LED board in the master lighting fixture to provide power to operate the LED board. The LED board in the master lighting fixture can be connected to the LED board in the satellite lighting fixture to form a circuit to allow the power provided by the LED driver to be transmitted to the LED board in the satellite lighting fixture. A defect in the LED board in the master lighting fixture or the satellite lighting fixture can open the circuit, which can prevent power from being transmitted through the LED boards to enhance the performance of LEDs in the LED boards or reduce a risk of damage that can be caused by the LED boards.

18 Claims, 5 Drawing Sheets

Related U.S. Application Data

(60) Provisional application No. 62/246,937, filed on Oct. 27, 2015.

(52) U.S. Cl.
CPC ..... *F21S 2/00* (2013.01); *H05B 33/0827* (2013.01); *H05B 33/0842* (2013.01); *H05B 37/0227* (2013.01)

(56) References Cited

U.S. PATENT DOCUMENTS

| | | | | |
|---|---|---|---|---|
| 2010/0134041 | A1 | 6/2010 | Radermacher et al. | |
| 2011/0279063 | A1* | 11/2011 | Wang | F21V 19/06 315/313 |
| 2012/0176049 | A1 | 7/2012 | Dhayagude | |
| 2012/0187856 | A1 | 7/2012 | Huang | |
| 2012/0262076 | A1 | 10/2012 | Briggs | |
| 2014/0055032 | A1 | 2/2014 | Keller | |
| 2014/0103804 | A1 | 4/2014 | Zhdanau | |
| 2014/0368116 | A1 | 12/2014 | Walters | |
| 2015/0245435 | A1* | 8/2015 | Peng | H05B 33/0821 315/185 R |
| 2016/0174318 | A1 | 6/2016 | Mignano | |
| 2016/0183338 | A1 | 6/2016 | Loomis | |

OTHER PUBLICATIONS

CA 2,937,020 received an Office Action, dated Jun. 5, 2017, 3 pages.
U.S. Appl. No. 15/216,932 received a Notice of Allowance dated Oct. 1, 2018, 10 pages.
U.S. Appl. No. 15/216,932 received a Non-Final Office Action dated Jun. 26, 2018, 10 pages.
U.S. Appl. No. 15/216,932 Response After Non-Final Office Action dated Aug. 23, 2018, all pages.

* cited by examiner

MODULAR LIGHT-EMITTING DIODE FIXTURES

CROSS-REFERENCE TO RELATED APPLICATIONS

This application is a divisional of Ser. No. 15/216,932, titled "Modular Light-Emitting Diode Fixtures," filed Jul. 22, 2016, which claims priority to U.S. Provisional Application No. 62/246,937, titled "LED Strip Fixture" and filed Oct. 27, 2015, the entirety of both applications are hereby incorporated by reference herein.

TECHNICAL FIELD

The present disclosure relates generally to fixtures with light-emitting diodes. More specifically, but not by way of limitation, this disclosure relates to a modular fixtures with light-emitting diodes and lighting systems using the modular fixtures.

BACKGROUND

Some lighting systems that use multiple lighting fixtures require that each fixture have its own LED driver to power the LEDs within the fixture. If there are a number of fixtures and the fixtures are controlled in the same manner, then the requirement for separate LED drivers may increase the cost of the system.

Other systems may use a single LED driver to power multiple LED boards configured in parallel. If one of the LED boards fails, then the current through the remaining LED boards may increase. The increased current may negatively affect the system by changing the brightness of the remaining LEDs, shortening the life of the LEDs, or damaging the LEDs. In some instances, the increased current may cause an LED board to overheat and may result in damage to the system and to the surrounding area.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings and each claim.

A lighting system includes at least one master lighting fixture and at least one satellite lighting fixture. The master lighting fixture is connected to a power source and includes an LED driver, at least one LED board, and an optional sensor. The LED driver provides power to the LED boards in the master lighting fixture and the satellite lighting fixture. The power from the LED driver is distributed approximately evenly across the LED boards. The LED boards are connected to the LED driver in a daisy chain so that the failure of one of the LED boards disrupts power distribution in the system and protects the remaining LED boards from damage.

The master lighting fixture may include one or more LED drivers. If more than one LED driver is included, then the drivers may have different characteristics, such as different power ratings.

The master lighting fixture and the satellite lighting fixtures are modular and are designed to facilitate different system configurations having different numbers of satellite lighting fixtures and different arrangements of the master lighting fixture relative to the satellite lighting fixtures.

These illustrative embodiments are mentioned not to limit or define the limits of the present subject matter, but to provide examples to aid understanding thereof. Illustrative embodiments are discussed in the Detailed Description, and further description is provided there. Advantages offered by various embodiments may be further understood by examining this specification and/or by practicing one or more embodiments of the claimed subject matter.

DETAILED DESCRIPTION

Certain aspects and features of the present disclosure are directed to modular lighting fixtures that use LED boards. A lighting system can include a master lighting fixture and one or more satellite lighting fixtures. The master lighting fixture and the satellite lighting fixture can each include one or more LED boards that include multiple LEDs. An LED driver associated with the master lighting fixture can provide power to LED boards within the master lighting fixture and/or to LED boards in one or more satellite lighting fixtures. The LED boards of the master lighting fixture can be connected to the LED boards of the satellite lighting fixture in series so that a failure in one of the LED boards prevents power from being transmitted through the LED boards. Since the remaining LED boards are not powered, the LEDs are not damaged by excess current. The loss of illumination caused by the loss of power indicates that there has been a failure.

In one example, the master lighting fixture and multiple satellite lighting fixtures are used to illuminate an area, such as an aisle, in a warehouse, manufacturing facility, or retail facility. The fixtures may be arranged linearly to illuminate a length of the aisle. The fixtures may be provided as a new installation or may be a retrofit of an existing installation. For example, the master lighting fixture and each of the satellite lighting fixtures may provide illumination for a four foot linear section. The lighting fixtures are modular in that different systems may use different numbers of satellite lighting fixtures or different arrangements of the master and satellite lighting fixtures.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative examples but, like the illustrative examples, should not be used to limit the present disclosure.

In the interest of clarity, not all of the routine features of the examples described herein are shown and described. It will, of course, be appreciated that in the development of any such actual implementation, numerous implementation-specific decisions must be made in order to achieve specific goals, such as compliance with application- and business-related constraints, and that these specific goals will vary from one implementation to another.

Figure 2:
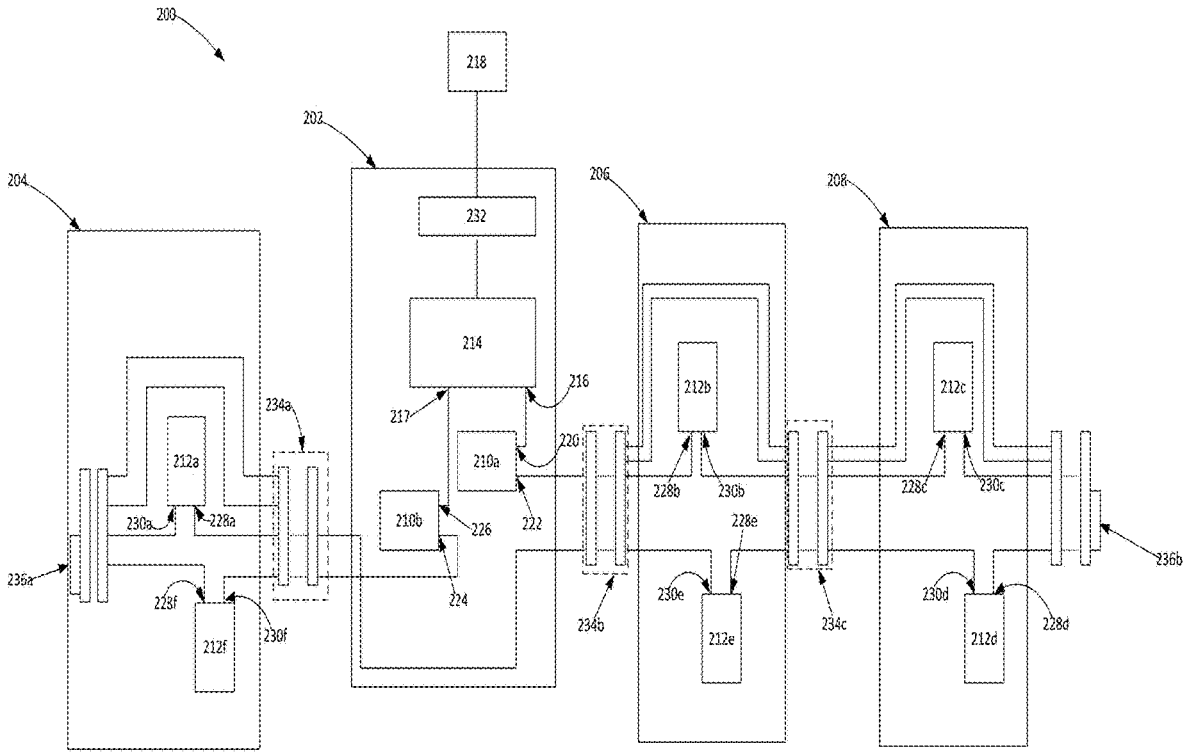
FIG. 2 is a block diagram of an example of a light-emitting diode strip fixture according to another example of the present disclosure.

In the example depicted in FIG. 2, the system 200 can include a master lighting fixture 202 and three satellite lighting fixtures 204, 206, 208. The master lighting fixture 202 is connected to a power source 218, such as line voltage or a power supply. The master lighting fixture includes an LED driver 214, LED boards 210*a-b*, and optionally a sensor 232, such as an occupancy sensor. If the master lighting fixture includes a sensor, then the sensor in combination with the LED driver 214 can control all of the LED boards in the master lighting fixture and the satellite fixtures connected to the LED driver.

In the example shown in FIG. 2, the satellite lighting fixture 204 includes LED boards 212*a* and 212*f*, the satellite lighting fixture 206 includes LED boards 212*b* and 212*e*, and the satellite lighting fixture 208 includes LED boards 212*c* and 212*d*. Each LED board can include multiple LEDs. The LEDs on the LED boards may be connected in series, in parallel or in a series/parallel combination. In one implementation, there are 14 parallel strings of LEDs with 2 LEDs in series in each string. There may also be a connection between two parallel strings of LEDs, such as a connection from a point between the 2 LEDs connected in series in one parallel string to a point between the 2 LEDs connected in series in another parallel string. The LEDs on the LED boards may be arranged in the same manner on each LED board or there may be differences in the LED arrangements between boards.

The LED driver 214 has a first output 216 and a second output 217. The LED board 210*a* can include a first power connection point 220 (also referred to herein as an input) and a second power connection point 222 (also referred to herein as an output). The LED board 210*b* can include a first power connection point 224 (also referred to herein as an input) and a second power connection point 226 (also referred to herein as an output). Each of the LED boards 212*a-f* includes a first power connection point (or input) 228*a-f* and a second power connection point (or input) 230*a-f*.

In this example, the first output 216 of the LED driver is connected to the input 220 of the LED board 210*a* and the output 222 of the LED board 210*a* is connected to the input 228*b* of the LED board 212*b*. The output 230*b* of the LED board 212*b* is connected to the input 228*c* of the LED board 212*c* and the output of the LED board 212*c* is connected to the input 228*d* of the LED board 212*d* via terminating connector 236*b*. The output 230*d* of LED board 212*d* is connected to the input 228*e* of the LED board 212*e* and the output of the LED board 212*e* is connected to the input 228*a* of LED board 212*a*. The output 230*a* of LED board 212*a* is connected to the input 228*f* of LED board 212*f* and the output of LED board 230*f* is connected to the input 224 of LED board 210*b*. The output of LED board 210*b* is connected to the second output 217 of the LED driver 214.

As shown in the example of FIG. 2, the LED boards 210*a-b*, 212*a-f* can be connected in series so that during normal operation the power from the LED driver is distributed across the LED boards. As an illustrative example, the LED driver 214 can be an 80 W LED driver. The LED driver 214 can receive power from the power source 218 and provide approximately 10 W of power to each of the LED boards 210*a-b*, 212*a-f* If the master lighting fixture includes a sensor, then the power distributed to the LED boards may be controlled, at least in part, by the sensor. For example, if the sensor is an occupancy sensor, then the LED driver may power up or shut down the LED boards based on a sensed condition.

If there is a board failure in one of the LED boards, then the distribution of power from the LED driver is disrupted and all of the LED boards lose power.

In the example depicted in FIG. 2, the system can also include lighting fixture connectors 234*a-c* for coupling the master lighting fixture 202 and the satellite lighting fixtures 204, 206, 208. For example, the satellite lighting fixture 204 can be coupled to the master lighting fixture 202 via the lighting fixture connector 234*a*. The master lighting fixture 202 can be coupled to the satellite lighting fixture 206 via the lighting fixture connector 234*b* and the satellite lighting fixture 206 can be coupled to the satellite lighting fixture 208 via the lighting fixture connector 234*c*. The system 200 may also include terminating connectors 236*a-b*.

Figure 3:
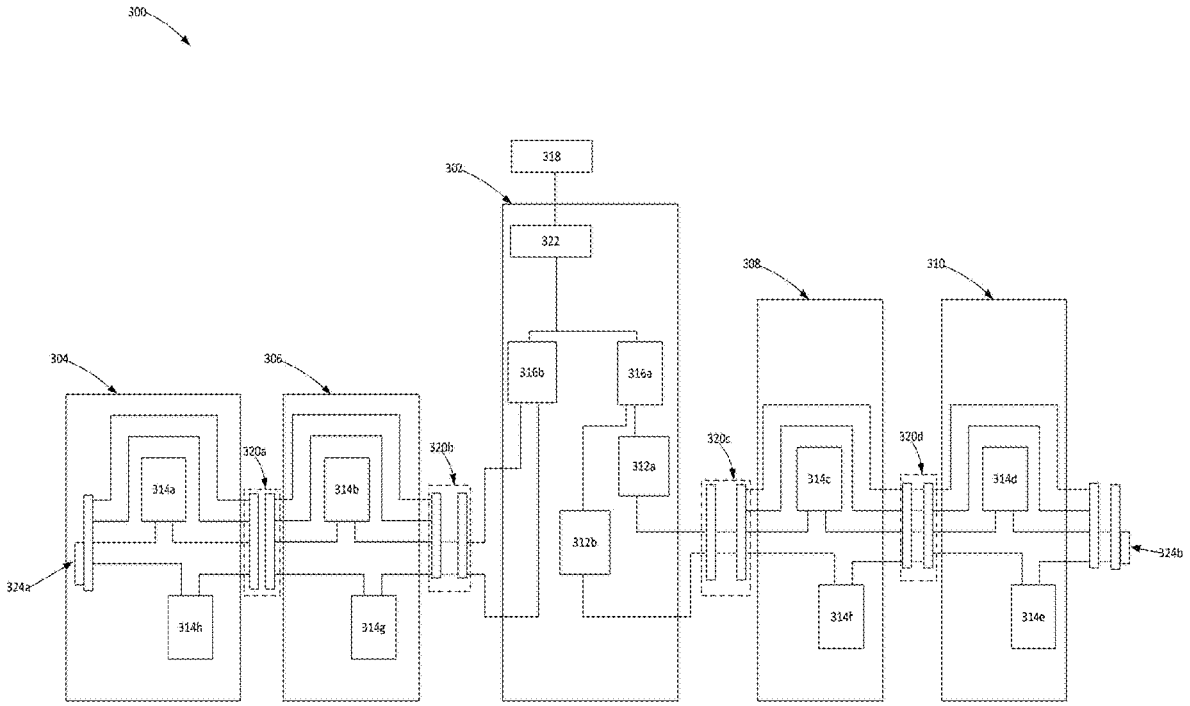
FIG. 3 is a block diagram of an example of a light-emitting diode strip fixture according to another example of the present disclosure.

FIG. 3 is a block diagram of another example of a lighting system 300 where the master lighting fixture includes two LED drivers. The system 300 includes a master lighting fixture 302 and four satellite lighting fixtures 304, 306, 308, 310. The master lighting fixture 302 can include two LED boards 312*a-b*. Satellite lighting fixtures 304, 306, 308, 310 can each include two LED boards. For example, the satellite lighting fixture 304 can include LED boards 314*a* and 314*h*, the satellite lighting fixture 306 can include LED boards 314*b* and 314*g*, the satellite lighting fixture 308 can include LED boards 314*c* and 314*f*, and the satellite lighting fixture 310 can include LED boards 314*d* and 314*e*.

The master lighting fixture 302 and the satellite lighting fixtures 304, 306, 308, 310 may be connected using fixture connectors 320*a-d*. The lighting fixture connectors can be any device for connecting two lighting fixtures, including a wire. One example of a lighting fixture connector 130 is an Ideal 30-082 luminaries disconnect power plug. For example, the satellite lighting fixture 304 can be coupled to the satellite lighting fixture 306 via lighting fixture connector 320*a*. The master lighting fixture 302 can be coupled to the satellite lighting fixtures 306, 308 via respective lighting fixture connectors 320*b*, 320*c* and the satellite lighting fixture 308 can be coupled to the satellite lighting fixture 310 via the lighting fixture connector 320*d*. Satellite lighting fixtures 304, 310 are also connected to their respective terminating connectors 324*a-b*.

The master lighting fixture is connected to a power source 318, such as AC line voltage or a power supply. The master lighting fixture 302 can also include an optional sensor 322, such as an occupancy sensor. If it includes a sensor, then the sensor in combination with the LED drivers 316*a*, 316*b* can control all of the LED boards in the master lighting fixture and the satellite fixtures based on a sensed condition.

The master lighting fixture can include one or more LED drivers, 316*a-b*, which are coupled to the power source. Each LED drivers powers multiple LED boards. In FIG. 3, LED driver 316*b* powers four LED boards 314*a-b*, 314*g-h* and LED driver 316*a* powers six LED boards 314*c-d*,314*e-f*.

The LED driver and the LED boards it powers are connected in a daisy chain. For example, an output of the LED driver 316*a* can be connected to an input on the LED board 312*a*. An output on the LED board 312*a* can be connected to an input on the LED board 314*c* and an output on LED board 314*c* can be connected to an input on the LED board 314*d*. An output on LED board 314*d* can be connected to an input on the LED board 314*e* via terminating connector 324*b*. An output on the LED board 314*e* can be connected to an input on the LED board 314*f*. An output on the LED board 314*f* can be connected to an input on the LED board 314*b*, and an output on the LED board 312*b* can be connected to another output of the LED driver 316*a*. In this manner the LED driver 316*a* evenly distributes power to each of the connected LED boards. For example, if the LED driver 316*a* is a 50 W driver then it distributes slightly more than 8 W to each LED board.

As another example, one output of the LED driver 316*b* can be connected to an input of the LED board 314*b*. An output of the LED board 314*b* is connected to an input of the LED board 314*a*. An output of the LED board 314*a* can be connected to an input to the LED board 314*h* via a terminating connector 324*a*. An output of the LED board 314*h* can be connected to an input of the LED board 314*g* and an output of the LED board 314*g* can be connected to an output of the LED driver 316*b*. In this manner the LED driver 316*b* evenly distributes power to each of the connected LED boards. For example, if the LED driver 316*b* is a 30 W driver then it distributes approximately 7.5 W to each LED board. FIG. 3 illustrates that different LED drivers with different characteristics may be combined in a single master lighting fixture. LED drivers with different power outputs may be used to drive different numbers of LED boards or LED boards with different power requirements. FIG. 3 also illustrates that there may be some variation in the power distribution across the connected fixtures within a system.

If there is a board failure in one of the LED boards, the failure disrupts the power distribution so that all of the other LED boards connected in the same chain lose power. This protects the remaining LED boards from excessive power or current.

For example, a failure in the LED board 314*c* can open the circuit including the LED driver 316*a*, and the LED boards 312*a-b*, 314*c-f*, which can prevent power from the LED driver 316*a* from being transmitted through the LED boards 312*a-b*, 314*c-f* One example of a failure in the LED board is a failure of multiple LEDs on the board. Typically, the failure of a single LED does not result in a board failure.

Figure 4:
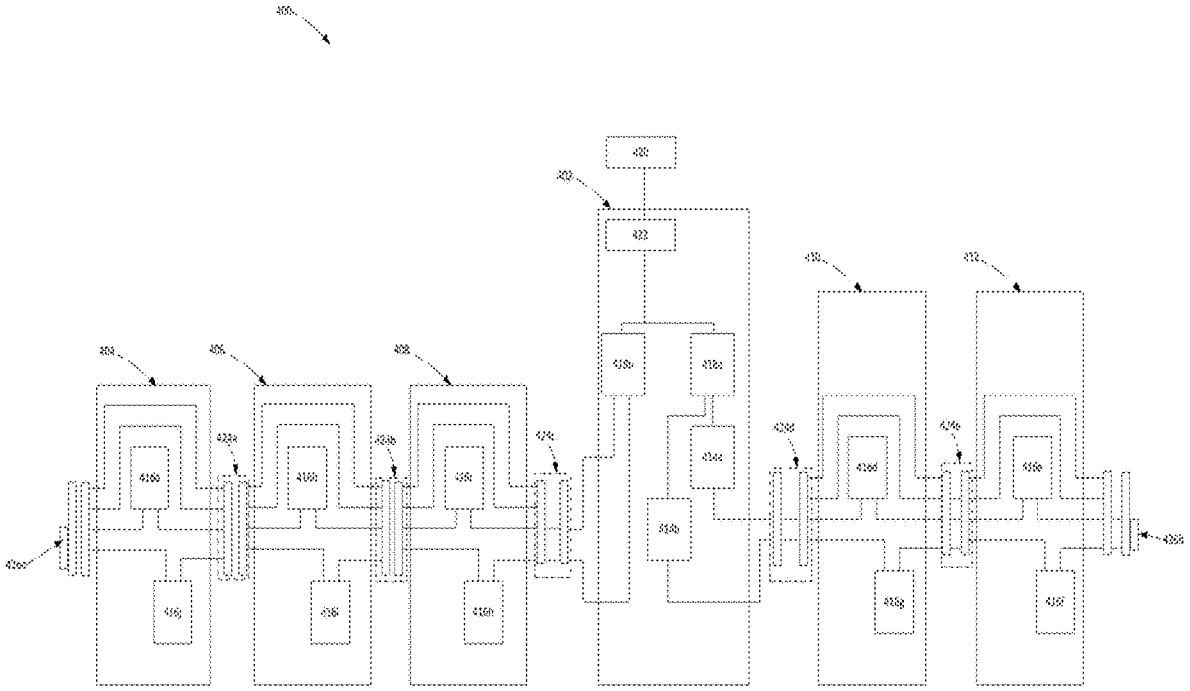
FIG. 4 is a block diagram of an example of a light-emitting diode strip fixture according to another example of the present disclosure.

The master lighting fixture and the satellite lighting fixtures may be modular components capable of use in systems having different configurations. For example, FIG. 4 is a block diagram of a system where the master lighting fixture 402 is placed between the satellite fixtures so that there are three satellite fixtures 404, 406, 408 powered by a first LED driver in the master lighting fixture and two satellite fixtures 410, 412 powered by a second LED driver in the master lighting fixture. One difference between the systems illustrated in FIGS. 3 and 4 is the number of LED boards and the number of satellite fixtures. FIG. 3 illustrates a master fixture 302 with two LED boards 312*a-b* and four satellite fixtures 304, 306, 308, 310 each having two LED boards 314*a-h* for a total of 10 LED boards. FIG. 4 illustrates a master fixture 402 with two LED boards 414*a-b* and five satellite fixtures 404, 406, 408, 410, 412 each having two LED boards 416*a-j* for a total of 12 LED boards.

The master lighting fixture 402 includes LED boards 414*a-b* and satellite lighting fixtures 404, 406, 408, 410, 412 include LED boards 416*a-j*. The master lighting fixture is connected to a power source 420 and may include an optional sensor 422. Connectors 424*a-e* couple the master lighting fixture 402 and the satellite lighting fixtures 404, 406, 408, 410, 412 together. Terminating connectors couple the LED boards within satellite fixtures 304 and 310.

In this example, the LED driver 418*a* is connected to the LED boards 414*a-b*, 416*d-g* to provide power to the LED boards 414*a-b*, 416*d-g*. The LED driver 418*b* is connected to the LED boards 416*a-c*, 416*h-j*. In one example, the amount of power provided by the LED driver 418*a* to each LED board 414*a-b*, 416*d-g* can be the same as the amount of power provided by the LED driver 418*b* to each LED board 416*a-c*, 416*h-j*. In another example, the amount of power provided by the LED driver 418*a* to each LED board 414*a-b*, 416*d-g* can be different from the amount of power provided by the LED driver 418*b* to each LED board 416*a-c*, 416*h-j*.

In FIG. 4 one output of LED driver 418*a* is connected to an input of LED board 414*a*. An output of LED board 414*a* is connected to an input of LED board 416*d* and an output of LED board 416*d* is connected to an input of LED board 416*e*. An output of LED board 416*e* is connected to an input of LED board 416*f* via terminating connector 426*b*. An output of LED board 416*f* is connected to an input of LED board 416*g* and an output of LED board 416*g* is connected to an input of LED board 414*b*. An output of LED board 414*b* is connected to a second output of the LED driver 418*a*.

One output of LED driver 418*b* is connected to an input of LED board 416*c*. An output of LED board 416*c* is connected to an input of LED board 416*b* and an output of LED board 416*b* is connected to an input of LED board 416*a*. An output of LED board 416*a* is connected to an input of LED board 416*j* via terminating connector 426*a*. An output of LED board 416*j* is connected to an input of LED board 416*i* and an output of LED board 416*i* is connected to an input of LED board 414*h*. An output of LED board 414*h* is connected to a second output of the LED driver 418*b*.

In the system of FIG. 4, if a failure occurs in one of the LED boards, then the power to the remaining LED boards connected to the same LED driver is disrupted.

Figure 5:
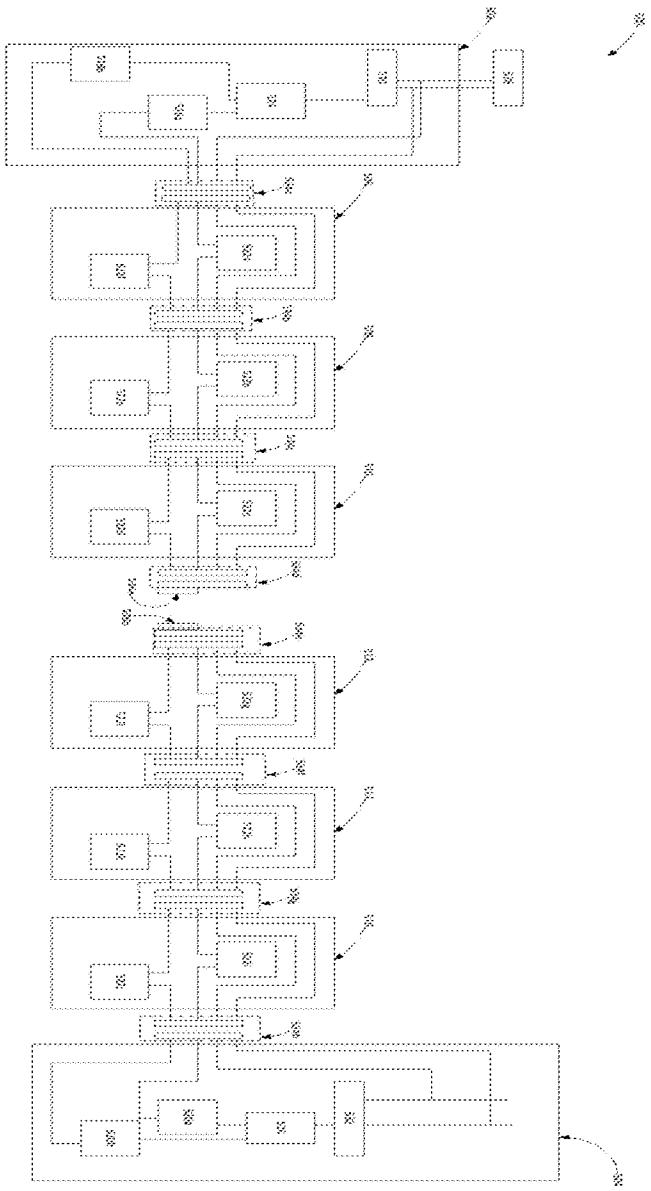
FIG. 5 is a block diagram of an example of a light-emitting diode strip fixture according to another example of the present disclosure.

In another example, FIG. 5 is a block diagram of a system with two master lighting fixtures 502 and 504 and six satellite fixtures 506, 508, 510, 512, 514, 516.

The master lighting fixture 502 is connected to a power source 528 and includes an LED driver 524, LED boards 518*a-b*, and optionally sensor 530. The second master lighting fixture 504 includes LED boards 520*a-b*, LED driver 526, and optionally sensor 532. The master lighting fixture 504 is connected to power source 528 via master fixture 502, satellite fixtures 506, 508, 510, 512, 514, 516, and connectors 534*a-h*.

The satellite lighting fixtures 506, 508, 510, 512, 514, 516 include LED boards 522*a*-1. In this example, the LED driver 526 powers the LED boards 520*a-b*, 522*g*-1. One output of the LED driver 526 is connected to an input of LED board 520*a*. An output of LED board 520*a* is connected to an input of LED board 522*i* and an output of LED board 522*i* is connected to an input of LED board 522*h*. An output of LED board 522*h* is connected to an input of LED board 522*g*. An output of LED board 522*g* is connected to an input of LED board 522*l* via terminating connector 536*b*. An output of LED board 522*l* is connected to an input of LED board 522*k* and an output of LED board 522*k* is connected to an input of LED board 522*j*. An output of LED board 522*j* is connected to an input of LED board 520*b* and an output of LED board 522*b* is connected to another output of LED driver 526.

The LED driver 524 powers the LED boards 518*a-b*, 522*a-f*. One output of the LED driver 524 is connected to an input of LED board 518*a*. An output of LED board 518*a* is connected to an input of LED board 522*a* and an output of LED board 522*a* is connected to an input of LED board 522*b*. An output of LED board 522*b* is connected to an input of LED board 522*c*. An output of LED board 522*c* is connected to an input of LED board 522*d* via terminating connector 536*a*. An output of LED board 522*d* is connected to an input of LED board 522*e* and an output of LED board 522*e* is connected to an input of LED board 522*f*. An output of LED board 522*f* is connected to an input of LED board 518*b* and an output of LED board 518*b* is connected to another output of LED driver 524.

The system of FIG. 5 illustrates that each of the satellite fixtures may include conductors or a bus to distribute power from a source other than an LED driver. In FIG. 5, the conductors connect the power source 528 in one of the master lighting fixtures with the other master lighting fixture. Although FIG. 5 does not illustrate that the satellite lighting fixtures connect to the power bus, they may do so. The connectors 534*a-c*, 524*f-h* may accommodate both the power bus and the connections between the LED boards. The connectors 534*d-e* connect the power bus between satellite lighting fixture 510 and satellite lighting fixture 512 and provide termination 536*a-b* for the devices connected to each LED driver.

In the system of FIG. 5, if a failure occurs in one of the LED boards, then the power to the remaining LED boards connected to the same LED driver is disrupted.

The system of FIG. 5 may be implemented so that each of the lighting fixtures provides illumination for approximately 4 linear feet so that the system may be used to retrofit a system that provides illumination for an aisle or other area that is 32 feet long.

Figure 1:
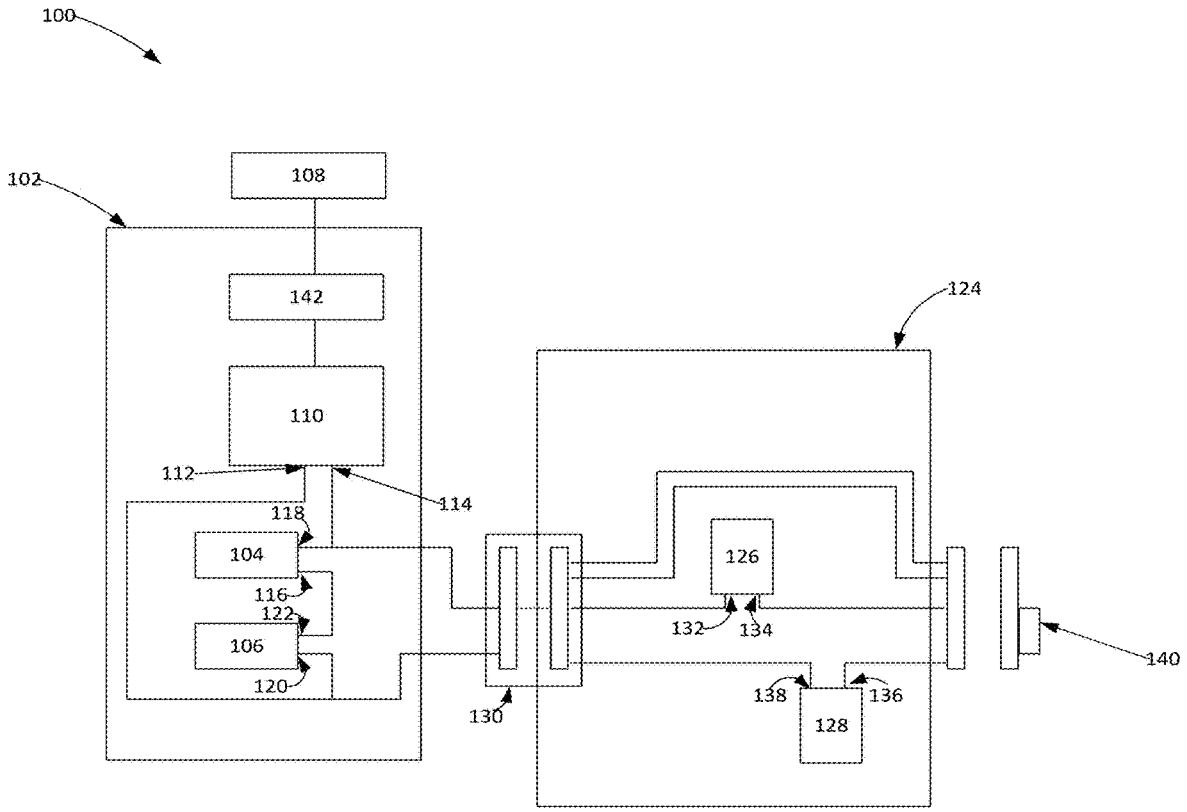
FIG. 1 is a block diagram of an example of a light-emitting diode strip fixture according to one example of the present disclosure.

FIG. 1 illustrates a system with only a single satellite fixture. The system 100 includes a master lighting fixture 102 and a satellite lighting fixture 124. The master lighting fixture 102 can be connected to a power source 108 and can include LED boards 104, 106, an LED driver 110, and optionally a sensor 142.

In the example depicted in FIG. 1, the LED driver 110 includes a first output 112 and a second output 114. The LED board 104 includes a first power connection point (also referred to herein as an input) 116 and a second power connection point (also referred to herein as an output) 118. The LED board 106 includes a first power connection point (also referred to herein as an input) 120 and a second power connection point (also referred to herein as an output) 122.

In one implementation of the master lighting fixture illustrated by FIG. 1, the LED boards 104, 106 each include 4 strings of LEDs arranged in parallel with each string having 7 LEDs arranged in series.

In this example the LED boards within the master lighting fixture are connected in series and the LED boards within the satellite lighting fixture are connected in series. The serially connected LED boards are connected in parallel.

The first output 112 of the LED driver is connected to the input 120 of the LED board 106. The output 122 of the LED board is connected to the input of LED board 104 and the output of LED board 104 is connected to the second output 114 of the LED driver. The first output 112 of the LED driver is also connected to the input 132 of the LED board 126. The output 134 of the LED board is connected to the input 136 of LED board 128 via terminating connector 140. The output of LED board 128 is also connected to the second output 114 of the LED driver.

FIG. 1 illustrates the modularity of the satellite fixture since it can be used with other satellite fixtures, as in FIGS. 2-5 or with only a master lighting fixture, as in FIG. 1.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure. Modifications include, but are not limited to, the inclusion of different or additional components in the master lighting fixture or the satellite lighting fixture, other configurations of one or more master lighting fixtures and one or more satellite lighting fixtures, other configurations of the master lighting fixture, other configurations of the satellite lighting fixtures, the inclusion of additional or alternative components on the LED boards, other arrangements of the LEDs on the LED boards, and additional or other types of sensors.

What is claimed is:

1. A lighting system comprising:

a master lighting fixture comprising:

an input for receiving a voltage;

a light-emitting diode ("LED") driver having a first output and a second output, the LED driver configured to receive the voltage;

a first plurality of LEDs on a first LED board, wherein the first LED board has a first power connection point and a second power connection point; and a second plurality of LEDs on a second LED board, wherein the second LED board has a first power connection point and a second power connection point;

a first external circuit having a first power connection point and a second power connection point, wherein the first external circuit is coupled to the master lighting fixture, wherein the first external circuit comprises:

a third plurality of LEDs on a third LED board, wherein the third LED board has a first connection point and a second connection point, and wherein the first connection point of the third LED board is couplable to the first LED board; and a fourth plurality of LEDs on a fourth LED board, wherein the fourth LED board has a first connection point and a second connection point, and wherein the second connection point of the fourth LED board is couplable to a second external circuit; and the second external circuit having a first power connection point and a second power connection point, wherein the second external circuit is coupled to the master lighting fixture; and wherein the second power connection point of the first LED board is couplable to the first power connection point of the first external circuit, and wherein the second power connection point of the second external circuit is coupled to the second power connection point of the second LED board, and wherein the second power connection point of the first external circuit is couplable to the first power connection point of the second external circuit.

2. The lighting system of claim 1 wherein the second external circuit comprises:

a fifth plurality of LEDs on a fifth LED board, wherein the fifth LED board has a first connection point and a second connection point, and wherein the first connection point of the fifth LED board is couplable to the first LED board; and a sixth plurality of LEDs on a sixth LED board, wherein the sixth LED board has a first connection point and a second connection point, and wherein the second connection point of the fourth LED board is couplable to the first external circuit.

3. The lighting system of claim 2 further comprising:

a first terminating connector coupling the third LED board and the fourth LED board.

4. The lighting system of claim 2 further comprising:

a second terminating connector coupling the fifth LED board and the sixth LED board.

5. The lighting system of claim 2, wherein the power provided to each of the first and second LED boards in the lighting fixture, each of the third and fourth LED boards in the first external circuit, and each of the fifth and sixth LED boards in the second external circuit is approximately the same.

6. The lighting system of claim 1, further comprising a sensor for detecting a motion of an object and transmitting a sensor signal to the LED driver, the LED driver configured to power the first LED board and the second LED board based on the sensor signal.

7. The lighting system of claim 1, further comprising a fixture connector for coupling the lighting fixture to each of the first external circuit or the second external circuit.

8. The lighting system of claim 1, wherein additional external circuits are coupled to the first external circuit or the second external circuit.

9. The lighting system of claim 1, wherein the master lighting fixture, the first external circuit, or the second external circuit is interchangeable with one or more additional master lighting fixtures or additional external circuits.

10. A method for powering a plurality of LED boards, wherein the plurality of LED boards includes a first LED board and a second LED board of a master lighting fixture, a third LED board and a fourth LED board of a first external circuit, and a fifth LED board and a sixth LED board of a second external circuit, comprising:

powering an LED driver of the master lighting fixture, wherein the LED driver has a first output and a second output; and powering the first LED board, the second LED board, the third LED board, the fourth LED board, the fifth LED board and the sixth LED board using the LED driver, wherein:

the first output of the LED driver is connected to a first power connection point of the first LED board, a second power connection point of the first LED board is connected to a first power connection point of the third LED board, a second power connection point of the third LED board is connected to a first connection point of the first external circuit, a second connection point of the first external circuit is connected to a first power connection point of the fourth LED board, a second power connection point of the fourth LED board is connected to a first power connection point of the fifth LED board, a second power connection point of the fifth LED board is connected to a first connection point of the second external circuit, a second connection point of the second external circuit is connected to a first power connection point of the sixth LED board, a second power connection point of the sixth LED board is connected to a first power connection point of the second LED board, and a second power connection point of the second LED board is connected to the second output of the LED driver.

11. The method of claim 10, wherein the plurality of LED boards includes a seventh LED board and an eighth LED board, further comprising:

powering the seventh and the eighth LED boards using the LED driver, wherein:

the first connection point of the first external circuit is connected to the first power connection point of the seventh LED board, the second connection point of the seventh LED board is connected to the first power connection point of the eighth LED board, and the second power connection point of the eighth LED board is connected to the second connection point of the first external circuit.

12. The method of claim 10, further comprising:

terminating the first external circuit using a terminating connector that connects the first connection point of the first external circuit and the second connection point of the first external circuit; and terminating the second external circuit using a terminating connector that connects the first connection point of the second external circuit and the second connection point of the second external circuit.

13. The method of claim 10, wherein powering the first LED board, the second LED board, the third LED board, the fourth LED board, the fifth LED board and the sixth LED board using the LED driver, further comprises:

receiving an input from a sensor; and controlling power output by the LED driver based on the input from the sensor.

14. A lighting system comprising:

a master lighting fixture comprising:

a light-emitting diode ("LED") driver having a first output and a second output;

a first plurality of LEDs on a first LED board, wherein the first LED board has a first power connection point and a second power connection point, the first power connection point of the first LED board is connected to the first output of the driver, and the second power connection point of the first LED board is connected to a first connection point of the master lighting fixture; and a second plurality of LEDs on a second LED board, wherein the second LED board has a first power connection point and a second power connection point, the first power connection point of the second LED board is connected to a fourth connection point of the master lighting fixture, and the second power connection point of the second LED board is connected to the second output of the LED driver;

a first external circuit comprising:

a third plurality of LEDs on a third LED board, wherein the third LED board has a first power connection point and a second power connection point, the first power connection point of the third LED board is connected to the first connection point of the master lighting fixture, and the second power connection point of the third LED board is connected to a first connection point of the first external circuit; and a fourth plurality of LEDs on a fourth LED board, wherein the second LED board has a first power connection point and a second power connection point, the first power connection point of the fourth LED board is connected to a second connection point of the first external circuit, and the second power connection point of the fourth LED board is connected to the second connection point of the master lighting fixture;

a second external circuit comprising:

a fifth plurality of LEDs on a fifth LED board, wherein the fifth LED board has a first power connection point and a second power connection point, the first power connection point of the fifth LED board is connected to a third connection point of the master lighting fixture, and the second power connection point of the fifth LED board is connected to a first connection point of the second external circuit; and a sixth plurality of LEDs on a sixth LED board, wherein the sixth LED board has a first power connection point and a second power connection point, the first power connection point of the sixth LED board is connected to a second connection point of the second external circuit, and the second power connection point of the sixth LED board is connected to a fourth connection point of the master lighting fixture, wherein the second connection point of the master lighting fixture is connected to the third connection point of the master lighting fixture.

15. The lighting system of claim 14, wherein the master lighting fixture further comprises a sensor for detecting a motion of an object and transmitting a sensor signal to the LED driver, the LED driver configured to power the first LED board, the second LED board, the third LED board, the fourth LED board, the fifth LED board, and the sixth LED board based on the sensor signal.

16. The lighting system of claim 14, further comprising:

a first terminating connector that couples the first connection point of the first external circuit and the second connection point of the first external circuit; and a second terminating connector that couples the first connection point of the second external circuit and the second connection point of the second external circuit.

17. The lighting system of claim 14, further comprising a fixture connector for coupling the master lighting fixture to each of the first external circuit or the second external circuit.

18. The lighting system of claim 14, wherein additional external circuits are coupled to the first external circuit or the second external circuit.

* * * * *